United States Patent [19]

Lorenz et al.

[11] Patent Number: 4,629,209

[45] Date of Patent: Dec. 16, 1986

[54] SAFETY SKI BINDING

[75] Inventors: Bettstein Lorenz, Zistersdorf; Friedrich Leichtfried, Traiskirchen; Tibor Szasz, Vienna; Heinz Wittmann, Vienna; Karl Stritzl, Vienna, all of Austria

[73] Assignee: TMC Corporation, Baar, Switzerland

[21] Appl. No.: 580,904

[22] Filed: Feb. 16, 1984

[30] Foreign Application Priority Data

| | | | |
|---|---|---|---|
| Feb. 16, 1983 | [AT] | Austria | 516/83 |
| Feb. 16, 1983 | [AT] | Austria | 517/83 |
| Sep. 27, 1983 | [AT] | Austria | 3432/83 |

[51] Int. Cl.[4] ..... A63C 9/08

[52] U.S. Cl. ..... 280/626; 280/634

[58] Field of Search ..... 280/626, 628, 631, 632, 280/634

[56] References Cited

U.S. PATENT DOCUMENTS

| | | | |
|---|---|---|---|
| 3,933,363 | 1/1976 | Schweizer et al. | 280/626 |
| 4,307,895 | 12/1981 | Storandt et al. | 280/632 |
| 4,475,742 | 10/1984 | Bauer et al. | 280/632 |
| 4,475,743 | 10/1984 | Wittmann | 280/632 |

FOREIGN PATENT DOCUMENTS 327068 1/1976 Austria .

*Primary Examiner*—John J. Love
*Assistant Examiner*—Richard Camby
*Attorney, Agent, or Firm*—Flynn, Thiel, Boutell & Tanis

[57] ABSTRACT

The invention relates to a safety ski binding, in particular a heel holder, comprising a sole holder, which is pivotal about a transversely extending axis on a bearing block, which sole holder is held in the downhill skiing position by a locking rocker arm which is pivotally supported on a sole holder, which locking rocker arm has on the one side a locking projection which, in the downhill skiing position, grips under a locking nose arranged on the bearing block, and on the other side is provided with a locking notch, into which is received a locking member biased by a release spring at least in the downhill skiing position, which locking member is supported in a pivotal spring housing which is movable relative to the bearing block and is, to a limited extent, movable in guideways provided therefor, whereby for the voluntary opening of the sole holder a release lever which is pivotally supported on the sole holder is provided through the operation of which the spring housing will be swung up and the locking member be removed from the locking notch, so that the locking rocker arm in this (disengaged) position is freely pivotal about its supporting axle and whereby the sole holder is loaded directly by an opening spring which urges the sole holder into the opening position.

17 Claims, 18 Drawing Figures

SAFETY SKI BINDING

FIELD OF THE INVENTION

This invention relates to a safety heel ski binding and, more particularly, to a heel binding having structure for making it possible to open the binding without activating the release spring.

BACKGROUND OF THE INVENTION

A safety ski binding of the above-mentioned type is described for example in German OS Pat. No. 28 38 904 (see FIGS. 1 to 5). In this known binding the spring is arranged in a cavity of the release lever which is pivotally supported on the sole holder. The release lever thus forms at the same time the spring housing. After a voluntary opening of the sole holder by operation of the release lever, this binding, however, is not in a position in which it is ready to receive a ski shoe therein. To reinsert the ski shoe or to close the sole holder, an additional manipulation is required. The release lever is first closed by applying a force so that the locking member again snaps in in the locking notch of the locking rocker arm, whereafter the sole holder can be closed by pressing down thereon. However, it is also possible to first insert the ski shoe into the binding to close the sole holder, and only then, for example by means of a ski pole to press the release lever into its closing position and thus the locking member into the locking notch of the locking rocker arm.

A further safety ski binding of this type is illustrated in Austrian Pat. No. 327 068 (corresponds to U.S. Pat. No. 3,933,363). This binding has proven to be very successful in practice. In this binding the release lever is pivotally supported on the axle of the locking rocker arm and has a bolt which extends through both slotted holes which are concentrically constructed with respect to the axle of the locking rocker arm on both sides on the sole holder and also slotted holes which are constructed on both sides on the spring housing. In this manner, during an operation of the release lever, a removal of the locking member from the locking notch of the locking rocker arm exists, which causes the locking rocker arm to come free from the bearing-block-fixed locking nose to enable the sole holder to pivot upwardly practically freely about its pivot axle. However, following a voluntary opening of the sole holder, this heel binding is also not in a position enabling it to receive a ski shoe therein as by stepping thereinto. It can be closed in the two ways which have been described above.

The purpose of the invention is to provide a safety ski binding of the above-mentioned type such that after a voluntary opening it is in a ready-for-stepping-in position.

The set purpose is inventively attained by providing a spring which biases the release lever or the spring housing with locking member thereon in the closing direction, by the spring being constructed as a torsion spring, which opposingly loads the sole holder with one leg and the release lever or the spring housing with the locking member thereon with the other leg, at least in the voluntary release phase of operation, whereby, following the occurrence of the voluntary opening of the sole holder, the locking rocker arm is held swung against a bearing-block-fixed counterstop by the closing blocking member which is loaded by the torsion spring, until the locking member is again received in the locking notch of the locking rocker arm.

The group of characteristics which is mentioned first is known by itself from Swiss Pat. No. 500 730, however, in an embodiment in which the locking rocker arm is constantly under the action of the release spring, even during the voluntary release, the spring force must be overcome even more yet than is the case during an automatic release, because the support surface of the locking rocker arm extends upwardly inclined. In addition, the sole holder with the nose separating the two recesses from one another must first be swung against the force of the release spring, this even when the release lever together with the release spring according to FIG. 3 is in the upper dead-center position. A separate opening spring is provided for operating the sole holder; between the operation of the sole holder and the spring housing there is no forced control. Through this further measure which characterizes the subject matter of the invention, on the one hand, a favored opening of the sole holder is brought about, on the other hand, the bringing together of the locking rocker arm and the spring housing is accomplished, so that the heel holder again moves into the position in which it is ready for receiving a ski shoe therein. This method of operation occurs thus fully automatically after the release lever and after the sole holder have been completely opened. Through this the operating comfort of the conventional bindings, the advantages of which the inventive binding also possesses, is substantially improved.

If the release lever at the same time forms the spring housing, then it is preferable if, inventively, the (further) torsion spring is supported on the axle from which the locking rocker arm is suspended with one leg supported on the sole holder and the other leg on the spring housing or on the release lever. This embodiment therefore does not need any additional structural parts for storing and arranging the (further) torsion spring.

A further preferred embodiment of the invention for a binding is the provision of the pivot axle for the sole holder at the rear of the binding adjacent to the base plate, wherein the spring housing is preferably also supported on the pivot axle of the sole holder and same is coupled with the release lever through a slip joint connection, for example, a bolt, which is secured to said release lever and which is slidingly received in a guideway on the spring housing. The guideway is formed by a slotted hole. A torsion spring is supported on the axle from which is suspended the locking rocker arm and has one leg thereof supported on the sole holder and the other leg supported on the bolt which couples the spring housing with the release lever. Through this a storing of the torsion spring in a binding system, as it is illustrated in the aforedescribed Austrian Pat. No. 327 068, is particularly simple.

A further characteristic of the invention, in which the pivot axle for the sole holder is arranged in the upper region of the bearing block with the torsion spring being supported either on the pivot axle for the sole holder or the axle which supports the locking rocker arm, with one leg thereof being supported from above on the bolt which couples the release lever with the spring housing and the other leg thereof being supported from below on the housing of the sole holder. In both cases no important structural changes on the heel holder for storing and arranging the additional spring are required.

A further development of the invention consists in the axle which supports the locking rocker arm being supported in two slotted holes provided in the side walls of the release lever and extending concentrically with respect to the pivot axle of the sole holder, the release lever being supported from above on the pivot axle for the sole holder, and the sole holder having for the bolt, which is secured to the release lever, a recess to facilitate the release action. Through these inventive measures results the possibility of voluntarily opening the heel holder both by pressing on and also by pulling on the release lever. During an opening by an upward pulling on the release lever, the axle which supports the locking rocker arm acts as a pivot axle for the release lever. During an opening by pressing down on the release lever, the pivot axle for the sole holder acts simultaneously as a pivot axle for the release lever, whereby in this case the relative movement between the axle which supports the locking rocker arm and the release lever is made possible by the two slotted holes in the release lever. In both cases, the heel holder is in the ready-for-stepping-in position following a voluntary opening.

In this embodiment of the invention, it is preferable if the support areas for the release lever are arced on a radius to the pivot axle for the sole holder. Through this a favorable force distribution results during an opening by pressing down on the release lever.

In order to now be able to carry out in this embodiment a closing of the sole holder from its open position with a small use of force, according to a further characteristic of the invention it is provided that the pivot range of the release lever which is determined by the two slotted holes in the release lever can be rendered inactive by means of a voluntarily operable lock. Thus, it is possible to effect with an active lock a closing of the heel holder with little use of force, as was already discussed above.

This lock can now be inventively provided by a spring-loaded slide member, which is movably supported on the release lever in the longitudinal direction thereof, which slide member has at one end an operating shoulder which can be manually gripped and at the other end at least one hook-shaped gripping element, which by operating the slide member grips around the axle of the locking rocker arm.

A further easily storable lock can be formed by providing a spring-loaded slide member movably supported on the release lever in the longitudinal direction thereof, which slide member has at one end an operating shoulder which can be manually gripped and at the other end has a fork-shape and carries two support elements, each of which extend laterally of the locking rocker arm and by operating the slide member can be moved under the axle of the locking rocker arm and can support same from below.

The invention has furthermore the purpose of making sure that the binding, following a voluntary opening, is always in an exactly defined position, namely either in the disengaged or unlocked position or in the ready-for-stepping-in position, and no jamming can take place between the web of the spring housing in its disengaged position and the locking rocker arm due to improper operation, in particular due to a premature release of the release lever.

To attain this further purpose, the torsion spring is inventively provided on the pivot axle of the sole holder with forwardly (in the direction of the sole holder) extending and crossing legs, whereby, viewed in the skiing position and in the first phase of the voluntary opening, the downwardly extending leg is supported from below on a stop on the sole holder and the upwardly extending leg is supported from above on a bearing-block-fixed stop, so that the torsion spring is active as an opening spring. The spring housing has also a stop, which is swingable in the plane of the leg of the torsion spring oriented in the plane of the bearing-block-fixed stop, and which in this position of the sole holder, viewed in elevational direction, is oriented at a spacing below the mentioned leg of the torsion spring. The stop in the second phase of the voluntary opening, in which the web is in its disengaged or unlocked position from the locking notch in the locking rocker arm, engages and lifts the leg of the torsion spring off from the bearing-block-fixed stop and starting with the voluntary opening phase urges the spring housing into its closing position with the locking rocker arm, so that the torsion spring is active as a return spring.

Due to the fact that the sole holder on the one hand and the release lever or the spring housing on the other hand are inventively loaded oppositely by the torsion spring, the heel holder during a voluntary opening of the sole holder by operation of the release lever and also then automatically, attains its ready-for-stepping-in position, such as when the skier prematurely releases the release lever before he would have stepped with his ski shoe out of the binding. The comfort of operation is therefore substantially improved.

A preferred embodiment of the invention consists in the provision of a further torsion spring arranged on the pivot axle of the sole holder, one leg of which torsion spring is supported on the bearing block and the other leg on the stop of the sole holder and which constantly urges the sole holder into the open position. Through this it is assured that the binding opens reliably also under unfavorable weather and slope conditions.

A further advantage of the invention consists in the force of the first torsion spring (of the return spring) being substantially less than the force of the further torsion spring (of the opening spring which loads the sole holder). Through this a secure support on the sole holder is always assured for the return spring.

A further advantage of the invention consists in the force of the (further) torsion spring being smaller, preferably substantially smaller, than the force of the opening spring which loads the sole holder.

BRIEF DESCRIPTION OF THE DRAWINGS

Further characteristics, advantages and details of the invention will now be described in greater detail with reference to the drawings which illustrate several exemplary embodiments of an inventive safety ski binding, in which:

FIG. 15 is a side view similar to FIG. 11 and FIG. 16 is a top view of the two-spring arrangement.

DETAILED DESCRIPTION

Figure 1:
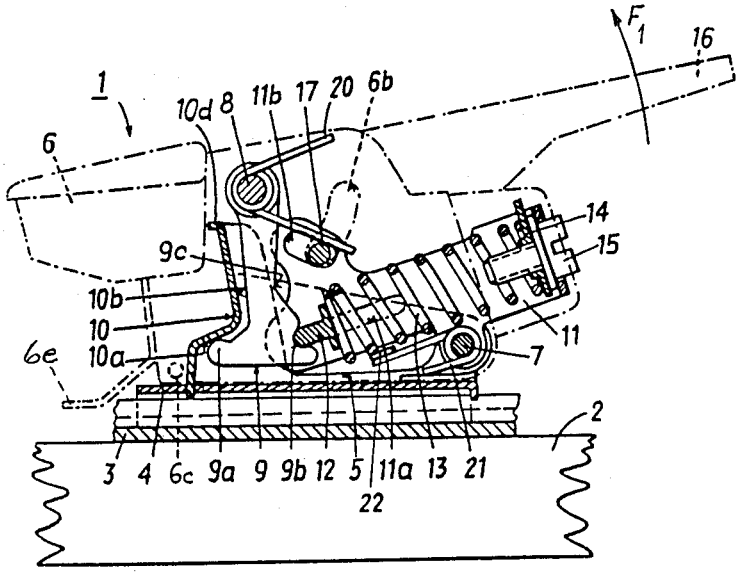
FIG. 1 is a central longitudinal cross-sectional view of a first embodiment of a safety ski binding which is in the downhill skiing position.

The safety ski binding according to the first exemplary embodiment according to FIGS. 1 to 4 includes a heel holder which in its entirety is identified by the reference numeral 1. The heel holder 1 has a guide rail 3 which is secured on the upper side of the ski 2 by means of screws (not illustrated), on which guide rail a base plate 4 of the heel holder 1 is movably guided in the longitudinal direction of the ski 2. The heel holder 1 can be locked in the respectively desired position in a conventional manner for adjusting the binding to different length ski shoes. The heel holder 1 is movably guided against the force of at least one thrust spring (not illustrated) on the guide rail, whereby one end of the thrust spring is supported in a conventional ski-fixed manner and the other end is fixed to the base plate 4 of the heel holder 1. An upstanding bearing block member 5 is secured to the base plate 4, and has a pivot axle 7 located at its rear region adjacent to the base plate 4. A sole holder 6 is pivotally supported on the pivot axle. The sole holder 6 has at its upper region a further axle 8 extending parallel to the first-mentioned axle 7, which axle 8 pivotally supports a locking rocker arm 9. The rocker arm 9 extends substantially downwardly from the axle 8 and has at its lower end a forwardly extending locking projection 9*a* which, in the downhill skiing position of the heel holder 1 according to FIG. 1, grips under a rearwardly projecting counterstop 10 on an upstanding front wall secured to the bearing block member 5.

A spring housing 11, which in the top view is approximately U-shaped, is also pivotally supported on the pivot axle 7 of the sole holder 6. The spring housing 11 has longitudinally extending slots 11*a* in the two bearing block members 5, which slots form a guideway for a locking member 12. The locking member 12 is biased by one end of a release spring 13, the other end of which is supported on an adjustable spring abutment 14 which can be adjusted in the axial direction of the release spring 13 by means of a screw 15 which is rotatably supported on the spring housing 11.

A locking notch 9*b* is provided in the rear facing side of the locking rocker arm 9 for receiving the locking member 12 therein. The locking member 12 is urged into the downhill skiing position by the release spring 13 whereat the locking member is received in the notch 9*b*. A recess 9*c* is provided on the rear facing side of the locking rocker arm 9 immediately above the locking notch 9*b*, into which recess 9*c* is received the locking member 12 for a short time during the operation of a release lever 16 in a manner which will yet be described.

The release lever 16 is generally U-shaped in top view and straddles the sole holder 6 and is pivotally supported on the axle 8, on which axle is also pivotally supported the sole holder 6 and the locking rocker arm. A bolt 17, which is secured to the release lever 16, extends parallel to the axle 8 between the legs of the U and through both the side wall slots 6*b* in the sole holder 6 and also the side wall slots 11*b* in the spring housing 11 and is slidingly guided in these two slots. The two laterally spaced and aligned slotted holes 6*b* provided on the sole holder 6 are arcuate and are arranged concentrically with respect to the pivot axle 8. The two laterally spaced and aligned slotted holes 11*b* are provided on spring housing 11 and extend in a straight manner approximately at a right angle with respect to the longitudinal extent of the slotted holes 6*b* on the sole holder 6.

The rearwardly projecting counterstop 10 which cooperates with the locking rocker arm 9 is, as stated above, constructed on a part of the front wall of the bearing block 5. The counterstop 10 forms, viewed from the upper side of the ski, first a locking surface 10*a* under which, in the downhill skiing position of the heel holder 1, is received the locking projection 9*a* on the locking rocker arm 9. A stop 10*d* is provided for preventing the sole holder 6 from swinging up too high during an opening of the binding. The stop 10*d* is formed on an upper end region of the front part of the bearing block 5 remote from the upper side of the ski and comprises at least one bent section which operatively cooperates with a shoulder 6*c* which is secured to the sole holder 6. The rearwardly facing surface 10*b* immediately above the stop surface 10*a* on the counterstop 10 is constructed as a substantially flat surface extending slightly frontwardly inclined in a direction toward the front jaw, which is not illustrated.

A torsion spring 20 is wound around the axle 8 which pivotally supports the locking rocker arm 9. The two legs of the torsion spring extend in a direction toward the tail end of the ski with one leg of the torsion spring 20 being supported on the bolt 17 and the other leg on the underside of the upper cover for the sole holder 6.

An opening torsion spring 21 is supported on the pivot axle 7 of the sole holder. One leg of the opening torsion spring 21 is supported on one end on the base plate 4 of the bearing block 5 and the other leg on a stop shoulder 22 which is secured to the sole holder 6 and extends into the inside of the binding.

The heel holder 1 of FIGS. 1 to 4 operates as follows: If a force from a ski shoe (not illustrated) which is inserted into the binding acts in a vertical direction onto the sole holder 6, the sole holder 6 pivots upwardly (clockwise) about its pivot axle 7. During this pivoting movement, the locking rocker arm 9 slides along the stop surface 10*a* of the bearing-block-fixed counterstop 10 and urges the locking member 12 rearwardly in the longitudinal slots 11*a* of the spring housing 11 against the force of the release spring 13. During the pivoting movement of the sole holder 6, the spring housing 11 is also pivoted in the same manner about the pivot axle 7, so that the locking rocker arm 9 remains under the action of the release spring 13. As soon as the projection 9*a* of the locking rocker arm 9 has passed the edge or corner section between the stop surface 10*a* and the rearwardly facing surface 10*b* whereat the release spring 13 is compressed to the maximum and whereat the elasticity range has been exceeded, then the sole holder 6, aided by the opening spring 21 which is arranged on the pivot axle 7, swings clockwise into its open position. The release spring 13 can now relax until the locking member 12 strikes the end regions of the longitudinal slots 11*a* of the spring housing 11 adjacent the locking rocker arm 9. The binding is now in its ready-for-stepping-in position, as illustrated in FIG. 4. The closing of the binding from this position is done simply by pressing with the ski shoe down on the spur 6*e* on the sole holder 6 until the sole holder is moved into the position which is illustrated in FIG. 1.

If now the heel holder is to be opened voluntarily by hand, the release lever 16 is then swung up, for example by hand, in direction of the arrow $F_1$ illustrated in FIG. 1. The bolt 17, which is thereby also swung upwardly, is moved in the slotted holes 6*b* to effect a swinging of the spring housing 11 upwardly clockwise about the pivot axle 7 so that the locking member 12 will be moved against the force of the release spring 13 from engagement with the locking notch 9*b* on the locking rocker arm 9. After the release lever 16 is pivoted to the position of FIG. 2, the notch 9*c* on the locking rocker arm 9 immediately above the locking recess 9*b* will permit a relaxing of the release spring 13 so that the locking rocker arm 9 is no longer spring-loaded. Thus, during the following occurring upward movement of the sole holder 6, the arm 9 will be moved upwardly with the sole holder under the action of the opening torsion spring 21 until the locking projection 9*a* slides along the rear surface 10*b* on the counterstop 10 toward the top thereof (see FIG. 3). The operation of the release lever 16 occurs also against the relatively small force of the torsion spring 20, as is illustrated by a comparison of FIG. 1 with FIG. 2. That is, one leg of the torsion spring 20 is supported on the bolt 17 to urge the spring housing 11 in a direction toward the upper side of the ski, i.e. counterclockwise. The locking member 12 is thereafter eventually urged against the locking rocker arm 9 and moves same along the back surface 10*b* of the bearing-block-fixed counterstop 10. The course of the back surface 10*b* is chosen such that during the last phase of the pivoting movement of the sole holder 6, the locking member 12, which swings counterclockwise downwardly with the spring housing 11 under the urging of the torsion spring 20, slides again into the locking recess 9*b* of the locking rocker arm 9. The release lever 16 which is also supported on the bolt 17 is at the same time moved into its closed position, so that now the heel holder is in its ready-for-stepping-in position illustrated in FIG. 4.

In the second exemplary embodiment according to FIGS. 5–8 the heel holder 101 differs from the one described above in that the pivot axle 107 which pivotally supports the sole holder 106 is arranged on the upper rear region of the bearing block member 105. Furthermore, for supporting the spring housing 111 at the rear end region of the bearing block member 105, a further axle 19 is also provided which extends transversely with respect to the longitudinal axis of the ski. The locking member 112 is here constructed in a wedge-shape at one end and has at its opposite end a flangelike extension on which rests a spring washer 18. One end of the release spring 13 is supported on the spring washer 18.

Due to the different support of the sole holder 106 on the bearing block member 105, the bolt 17 extends through a pair of laterally spaced and axially aligned guide slots 111*b* which are approximately arc-shaped and which are provided on the lateral side walls of the spring housing 111.

Furthermore, the opening torsion spring 121, which loads the sole holder 106, is arranged adjacent but rearwardly of the upper end region of the counterstop 110, with one leg resting against the sole holder 106 and the other leg against the bearing block member 105. The stop which limits the upward pivoting movement of the sole holder 106 is formed by a shoulder 106*c* secured to the sole holder 106.

The torsion spring 120 which oppositely loads the sole holder 106 on the one side and the spring housing 111 and release lever 116 on the other side is in this embodiment supported on the pivot axle 107 of the sole holder 106, which pivot axle 107 is secured to the bearing block member 105.

A housinglike cover 23, which is preferably manufactured of plastic, covers the rearward end region of the spring housing 111 and is fixedly connected to the spring housing 111, for example by plural rivets not shown. The cover 23 thus pivots together with the spring housing 111. The cover 23 has a window therein which is provided with a scale, which window is provided for indicating the adjusted initial spring tension. Since this construction is known by itself, the window is not illustrated separately in the drawing figures.

Figure 2:
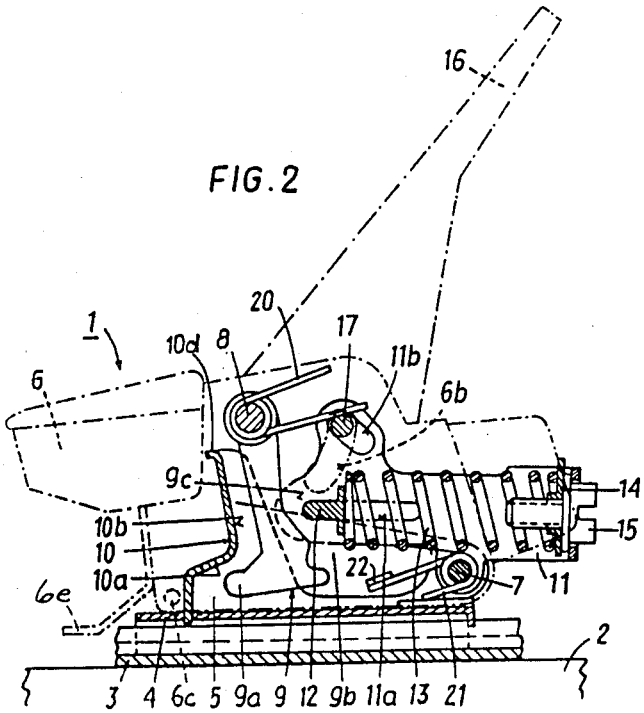
FIG. 2 is a central cross-sectional view of the safety ski binding in a first position during a voluntary opening.
Figure 3:
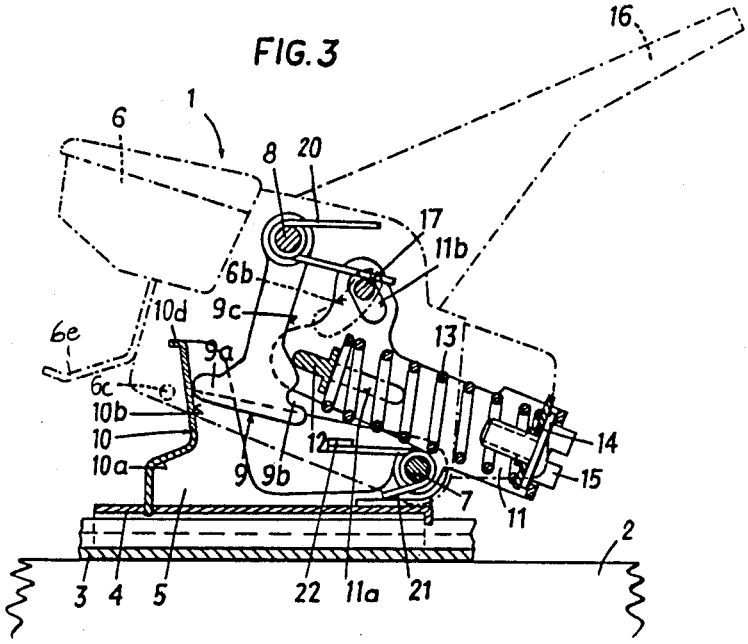
FIG. 3 is a central cross-sectional view of the safety ski binding in a second position during a voluntary opening.
Figure 4:
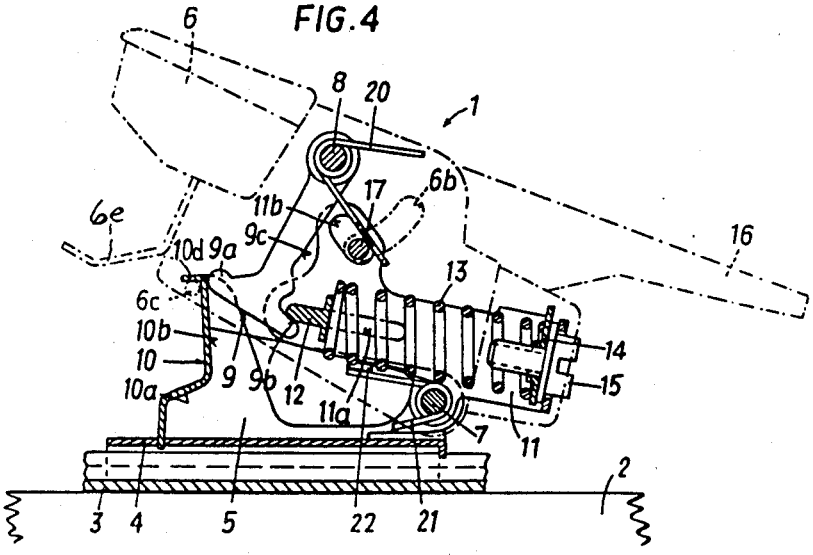
FIG. 4 illustrates the open position of the safety ski binding after a voluntary opening and after the occurrence of a safety release.
Figure 5:
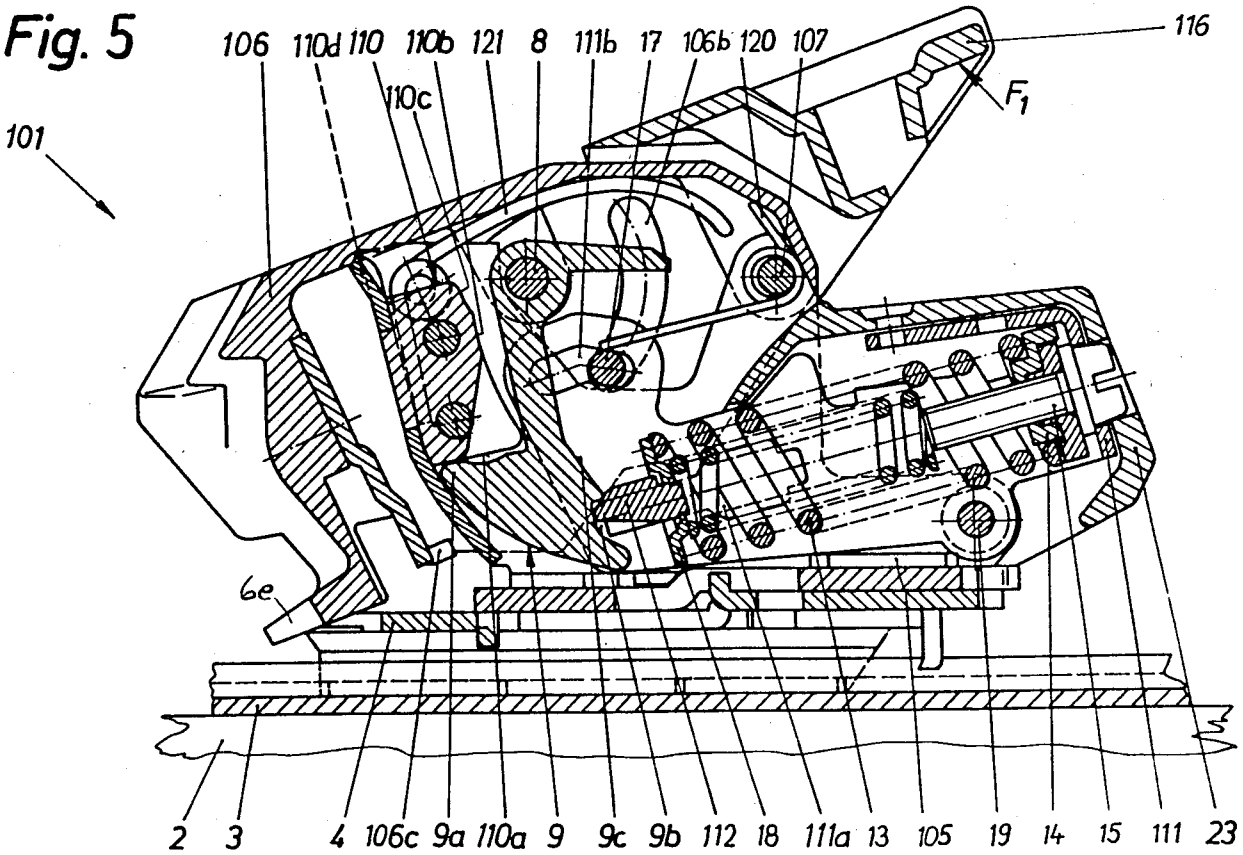
FIG. 5 is a central longitudinal cross-sectional view of a second embodiment of a safety ski binding which is in the downhill skiing position.
Figure 6:
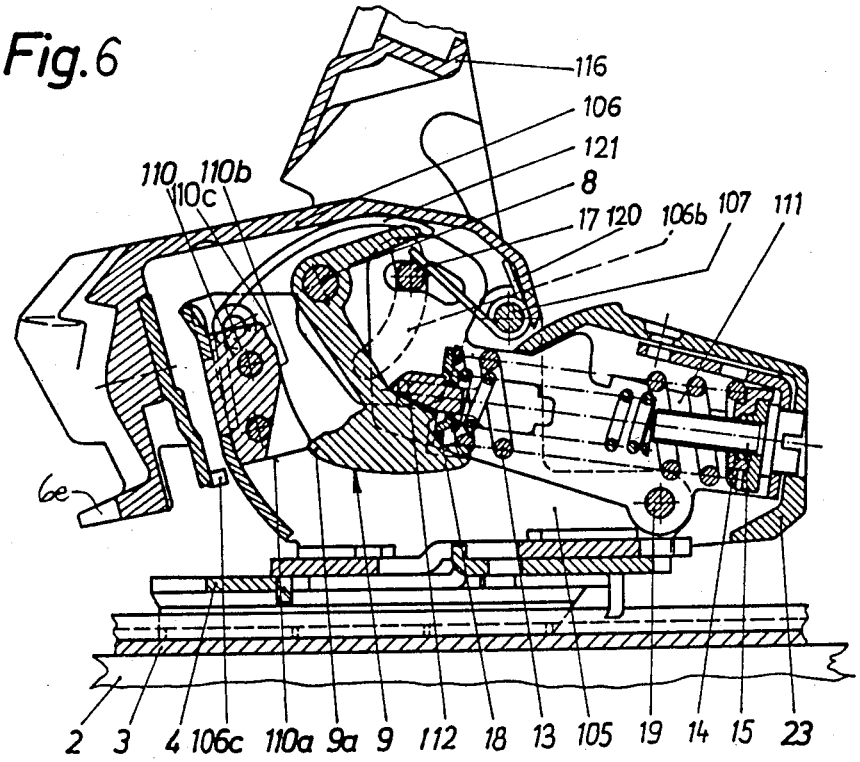
FIG. 6 is a central cross-sectional view of the safety ski binding in a first position during a voluntary opening.
Figure 8:
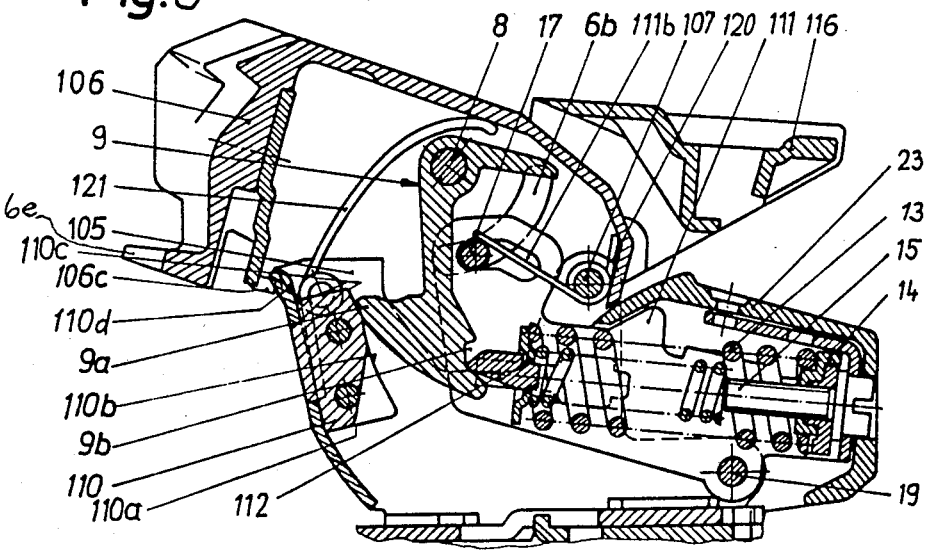
FIG. 8 illustrates the open position of the safety ski binding after a voluntary opening and after the occurrence of a safety release.
Figure 7:
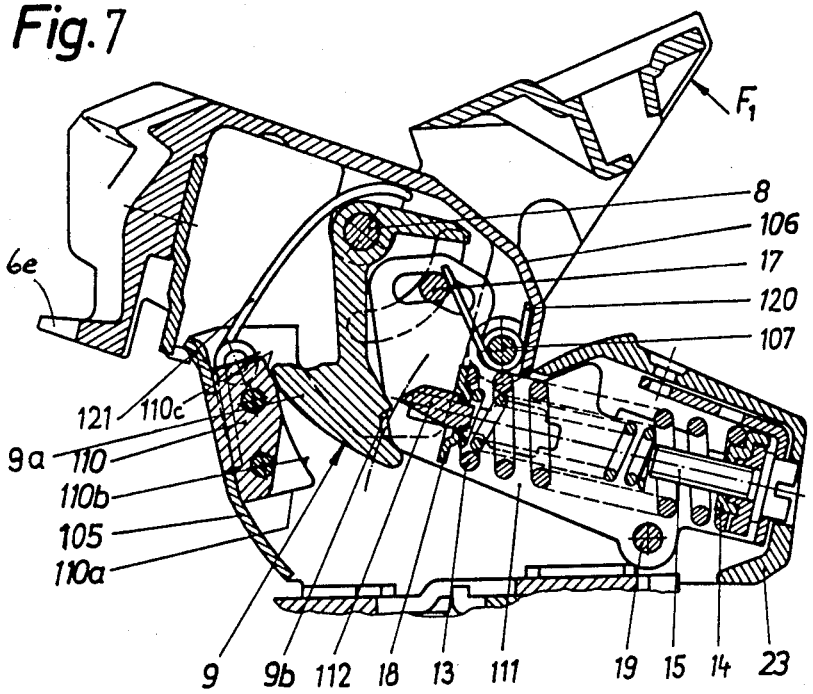
FIG. 7 is a central cross-sectional view of the safety ski binding in a section position during a voluntary opening.

The further design and the operation of the heel holder 101 in FIGS. 5 to 8 correspond otherwise with the embodiments already described, FIGS. 6–8 illustrating the positions which correspond in sequence to FIGS. 2–4 of the first exemplary embodiment.

Figure 9:
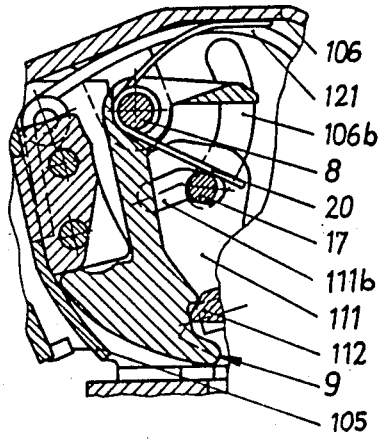
FIG. 9 is a cross-sectional side view of a further exemplary embodiment of the inventive safety ski binding in the downhill skiing position, whereby, however, this figure illustrates only the details which have been changed compared to the second exemplary embodiment of FIGS. 5 to 8.

The opening spring 20 which moves the heel holder 101 following a voluntary opening into its ready-for-stepping-in position can now also, (in a modification of the second exemplary embodiment, however, with reference to the first embodiment) as it is illustrated in FIG. 9, be supported on the axle 8 which supports the locking rocker arm 9. Also in this embodiment the spring is constructed as a torsion spring 20 which is wound around the axle 8 and of the two legs which extend in a direction toward the tail end of the ski, one is supported on the upper side of the bolt 17 and on the upper side of the top surface of the sole holder 6. The function of this exemplary embodiment corresponds to the one illustrated in FIGS. 1 to 4 or 5 to 8. Therefore, the illustration and description of further details is not needed.

In all of the embodiments described above, the heel holder is ready for stepping in following a voluntary opening and can be closed by a mere insertion of the ski shoe into the sole holder, it being recognized that the heel of the ski shoe engages the spur 6*e* and a downward force is exerted thereon. Also a closing of the sole holder by hand is possible by pressing down on the upper surface thereof, whereby, however, a relatively large force must be overcome in order to do this. However, it is also possible in all embodiments described thus far to move the heel holder into its closed position with a substantially lesser force. For this purpose, starting out from the position illustrated in FIG. 4 or FIG. 8, the release lever 116 is swung up sufficiently far until the locking member 12 again comes free from engagement with the locking notch 9*b* on the locking rocker arm 9. This operation occurs, as is shown by a comparison of FIG. 4 with FIG. 3 or FIG. 8 with FIG. 7, only against the small force of the torsion spring 20, 120. The sole holder 6, 106 is subsequently moved manually into its closing position, whereby only the force of the opening spring 21, 121 need be overcome, which force is small compared to the release spring 13. The locking member 12 engages again the locking notch 9*b* of the locking rocker arm 9 due to the release lever 116, which now is swung in this example manually in the closing direction. During this procedure, the release spring 13 is only slightly compressed. In this manner the heel holder 106 can be manually moved with a lesser force into its closing position. This mode of operation will be chosen primarily when the heel holder is to be closed during transport of the skis. This mode of operation for closing the heel holder is also advantageous for the binding installer, particularly during the adjustment of the binding to the ski shoe length.

Figure 10:
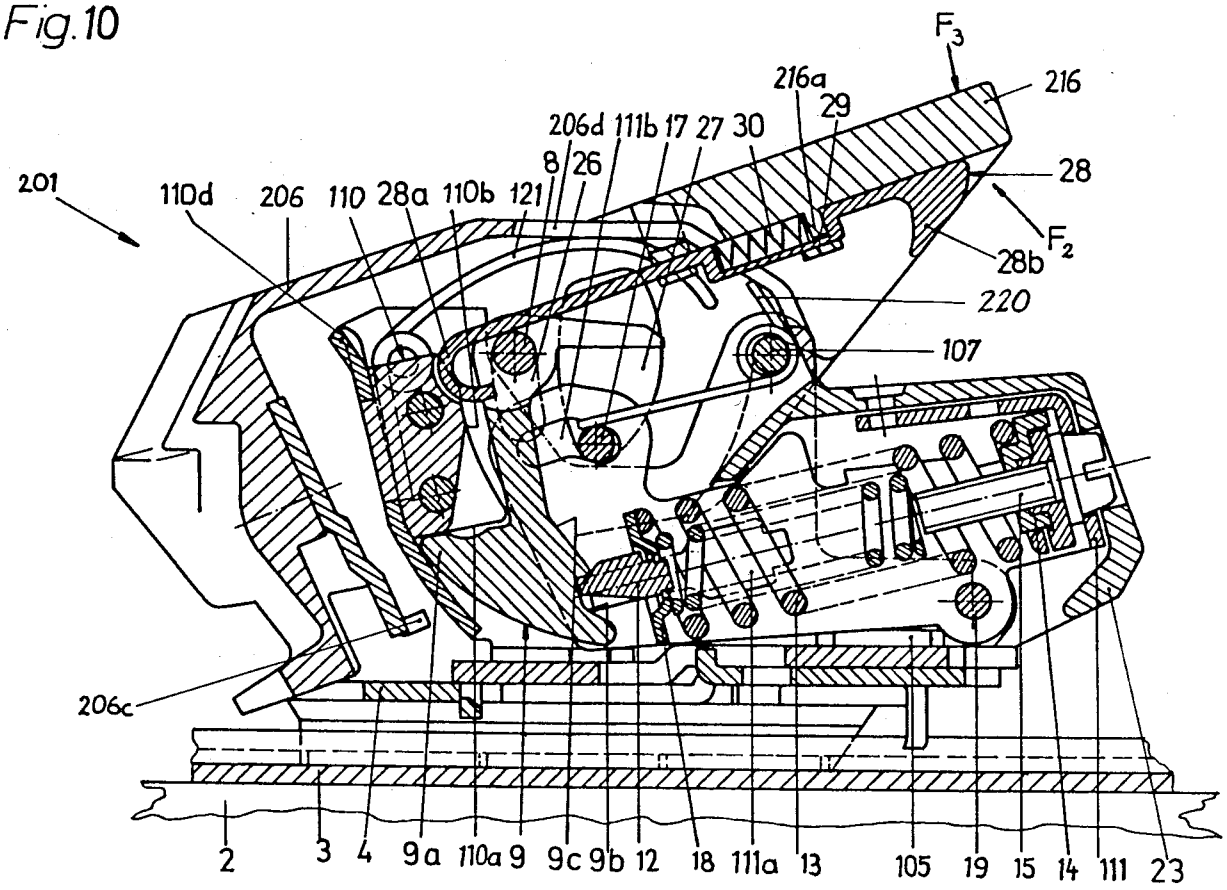
FIG. 10 illustrates a further exemplary embodiment in a position which is analogous to FIG. 1 and FIG. 5.

The heel holder 201 which is illustrated in FIGS. 10 corresponds substantially to the embodiment of FIGS. 5 to 8. The following description discusses only these details which are differently constructed compared with the first exemplary embodiment. For example, the sole holder 206 has a greater height than the exemplary embodiments of FIGS. 5–8 and 9, so that in the region between the locking rocker arm 9 and the upper cover of the sole holder 206, an uninhibited pivoting movement of a slide member 28 will occur. The slide member 28 is secured to the release lever 216. The pivoting movement of the release lever will yet be described in greater detail. A pair of laterally spaced and aligned arcuate slotted holes 26 are provided in each of the side walls of the release lever 216, through which slotted holes 26 extends the axle 8 supported on the sole holder 206. Each of the slotted holes 26 extend concentrically with respect to the pivot axle 107. The locking rocker arm 9 is also pivotally suspended from the axle 8. In the downhill skiing position of the heel holder 201 according to FIG. 10, the axle 8 is oriented at the upper end region of the slotted holes 26. The laterally spaced side walls of the release lever 216 are supported from above on the pivot axle 107 of the sole holder 206. For this purpose, the respective support region of the release lever 216, as is illustrated in FIG. 10, can be curved corresponding to the radius of the pivot axle 107. The bolt 17 which is secured to the release lever 216 extends now through each of a pair of laterally spaced and aligned recesses 27 provided in the side walls of the sole holder 206. The recesses 27 replace the slotted holes 6*b* of the preceding exemplary embodiments. The boundary edge of each recess 27 on the side adjacent axle 8 is curved extending concentric to the pivot axle 107. The boundary edge of each recess 27 on the side adjacent the pivot axle 107 is also curved but extending concentrically with respect to the axle 8.

The slide member 28 is movably supported in the longitudinal direction of the release lever 216 on the underside thereof. For supporting the slide member 28 on the release lever 216, it is possible to provide for example, and as illustrated in FIG. 10, one or more guide flanges 29 which hold the slide member 28 on the underside of the release lever 216. The slide member 28 itself extends approximately over the entire length of the release lever 216. The first end of the slide member 28 extends in direction toward the sole holder 206 to a location above the locking rocker arm 9. The slide member 28 extends through an opening 206*d* extending in the longitudinal direction of the ski and in the upper cover of the sole holder 206. The release lever 216 does not extend into the opening 206*d*. The slide member 28 has a hooklike gripping element 28*a* provided at the front end of the slide member 28 in a manner which will yet be described for gripping around the axle 8 supported on the sole holder 206. For this purpose, the locking rocker arm 9 and the counterstop 10 are provided with corresponding centrally oriented recesses which are not identified in detail. The slide member 28 is held in its position which is illustrated in FIG. 10 and in which the gripping element 28*a* is spaced in front of the axle 8 by a spring 30. The spring 30 is constructed as a compression spring and is arranged in a recess in the slide member 28. One end of the spring 30 is supported on the slide member 28 and the other end thereof is supported on a shoulder 216*a* of the release lever 216. The support shoulder 216*a* projects into the recess of the slide member 28. Furthermore, the slide member 28 is provided with an operating shoulder 28*b* to facilitate a manual gripping by the hand.

This heel holder can now be opened voluntarily both by pulling upwardly on or by pressing downwardly on the release lever 216. During an opening by pulling up on the release lever 216 in direction of the arrow $F_2$ in FIG. 10, the release lever 216 is supported on the axle 8, which now functions as the pivot axle for the release lever 216. An unhindered pivoting movement of the release lever 216 and the slide member 28 supported thereon is made possible by the recess 206*d* provided in the sole holder 206 to facilitate an opening of the sole holder 206 in the manner described with reference to the first exemplary embodiment of FIGS. 1 to 4.

If the heel holder is to be opened by the applying of a downward pressure onto the release lever 216, for example by means of the ski, a ski shoe or a ski pole, the release lever 216 will be swung downwardly in direction of the arrow $F_3$ in FIG. 10. The release lever 216 is thereby supported on the bearing-block-fixed pivot axle 107, about which pivot axle 107 the sole holder 20 and the release lever 216 are also both pivotally arranged. The relative movement which takes place between the release lever 216 and the axle 8 supported on the sole holder 206, is made possible by the two slotted holes 26 in the side walls of the release lever 216. During a pivoting of the release lever 216, the bolt 17, which is secured to the release lever 216, is swung up therewith and this movement is made possible by the two recesses 27 in the sole holder 206. The spring housing 111 is also pivoted upwardly about the axle 19 by action of the bolt 17 thereon so that the locking member 12 will be rendered free of the force of the release spring 13 by being moved from engagement with the locking notch 9b in the locking rocker arm 9 and, as has already been described in the preceding exemplary embodiments, into the region of the recess 9c of the locking rocker arm 9. After the release lever 216 is pivoted, the sole holder 206 (either by a lifting up of the ski shoe which is inserted into the sole holder 206 or through the urging of an opening spring not shown in FIG. 10 but corresponding to the spring 21 in the embodiment of FIGS. 1 to 4), starts to pivot upwardly about the pivot axle 107; at the same time the locking rocker arm 9 swings slightly rearwardly and the axle 8 on which the locking rocker arm 9 is suspended slides slightly upwardly in the slotted holes 26. After a certain angle of traverse of the sole holder 206, the locking rocker arm 9, which slides rearwardly along the counterstop 10, grips the locking member 12, which now sliding along the locking rocker arm 9 is pivoted upwardly together with the spring housing 111 about the axle 19. The bolt 17 which is secured to the release lever 216 swings also up with the pivoting of the spring housing 111 to simultaneously cause the release lever 216 to pivot upwardly in direction of the arrow $F_2$ in FIG. 10 about the axle 8, which is now the new pivot axle for the release lever 216 (thus, in the opposite direction to the applied pressure direction). During a new direction of pivoting movement of the release lever 216, same moves away from the pivot axle 107. The locking rocker arm 9 can now swing upwardly with the sole holder 206 past the counterstop 10. During the last phase of the upward swinging movement of the sole holder 206, the torsion spring 220, one leg of which is supported on the sole holder 206 and the other leg of which is supported on the bolt 17, and which during the just-described sequences of movement, was initially tensioned and became active to urge the bolt 17 and thus the spring housing 111 downwardly to cause the locking member 12 to again slide into the locking notch 9b of the locking rocker arm 9. This also causes the release lever 216, which supports the bolt 17, to be moved into its closed position, so that now the heel holder 201 is in its ready-for-stepping-in position.

The heel holder 201 which is now ready for a ski shoe to step therein can again be closed by pressing down on the sole holder 206. However, in order to be able to carry out a manual closing of the sole holder 206 with little force, the aforementioned slide member 28 is provided.

The slide member 28 is gripped with the hand and is pulled against the force of the weak spring 30 in a direction away from the sole holder 206, i.e. rightwardly. The hooklike gripping element 28a thereby grips the axle 8 so that now the two laterally spaced slotted holes 26 are rendered ineffective. In this position of the slide member 28, the release lever 216 is swung up sufficiently far until the locking member 12 again comes free from the locking notch 9b of the locking rocker arm 9. This operation occurs only against the small force of the torsion spring 220. Subsequently, the sole holder 206 is moved manually into its closing position such that only the force of the opening spring 121 has to be overcome. The release lever 216 is now swung manually with the still-working slide member 28 into the closing direction, whereby the locking member 12 is received again in the locking notch 9b of the locking rocker arm 9. Even though this engagement occurs against the force of the release spring 13, a substantially smaller force than during a closing alone through the sole holder 206 is required.

In order now not to have to hold the slide member 28 at all times by hand during the previously described operational movements, a not-illustrated resilient detent mechanism for the slide member 28 can be provided on the release lever 216, which detent mechanism during the operation of the slide member 28 is received in a corresponding locking recess in the lever. An automatic unlocking of the slide member 28 from the lever 216 is possible for example by the operating region of the slide member 28 being designed as a separate structural part. In other words, the operating region is constructed as a two-arm lever which is hingedly connected to the slide member 28, one of the lever arms having the operating shoulder 28b thereon and is urged by a further spring in a direction toward the underside of the release lever 216 and the second lever arm of which extends downwardly away from the underside of the release lever 216. The second lever arm can now during a pressing down of the release lever 216 for example strike the pivot axle 107, which causes the lever to be pivoted to effect an automatic release of the locking relation.

Furthermore, it is possible to form the block for the axle 8 by two hooklike gripping elements on the slide member 28, which grip the locking rocker arm 9 at laterally spaced locations straddling the axle 8. With this the provision of a recess in the locking rocker arm 9 is not required.

For blocking the axle 8 for an easier closing of the sole holder 206, it is possible to provide a slide member with two lateral support plates, which by operating the slide member can be moved laterally of the locking rocker arm under the axle 8 to support the axle from below. For reasons of space, it would be preferable in this case if the support plates which are provided at the end region of the slide member, viewed in the downhill skiing position of the heel holder according to FIG. 10, would be provided laterally of the locking rocker arm 9 in the area behind the axle 8. Therefore, the slide member must be moved in a direction toward the sole holder. In place of the support plates, it is also possible to provide gripping elements, which in the nonoperated position of the slide member are provided in the area behind the axle 8 of the locking rocker arm 9 and are movable laterally of the locking rocker arm 9 on the axle 8.

Figure 10A:
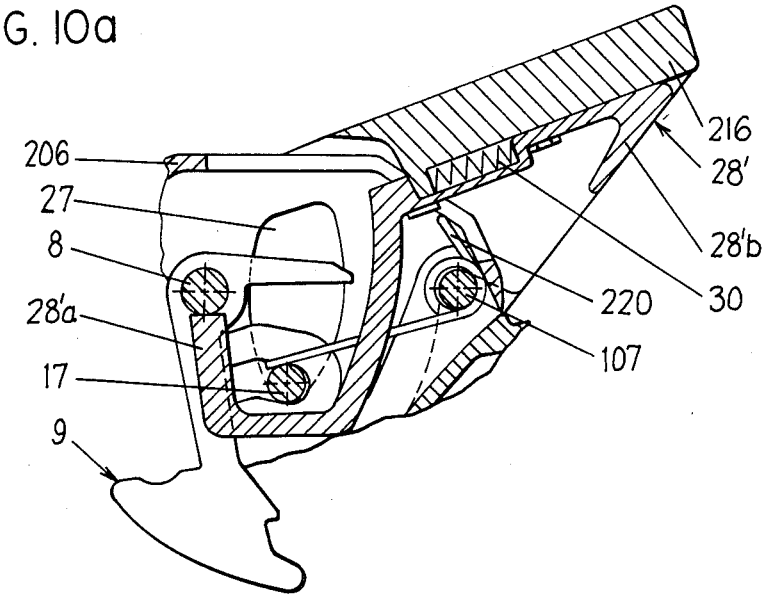
Figure 10B:
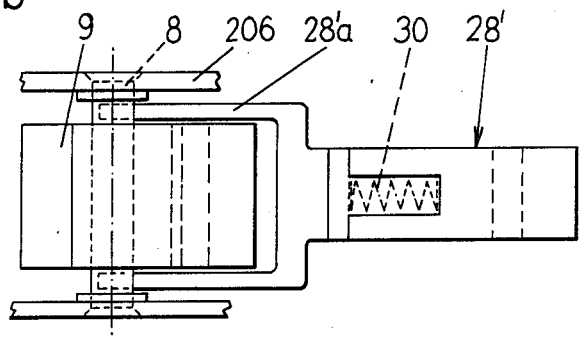

Also it is possible in the last-described exemplary embodiment according to FIG. 10 to use as an additional spring, for urging the release lever and the spring housing into the closing direction, the springs which are described in the other exemplary embodiments. In a further embodiment according to the FIGS. 10a and 10b the slide member 28' has at one end the operating shoulder 28'b which can be gripped manually. The other end of portion 28'a of the slide member 28' is divided forkshaped and surrounding the bolt 17 so that the slide member 28' can be operated by pushing or pulling against the force of the spring 30. Therefore the spring 30 is always loaded in an appropriate manner (against push or against pull). FIG. 10a shows an embodiment in which the slide member 28' can be operated by pull, i.e. in the left direction in the drawing. Doing so the spring 30 will be pressed and the ends of the end portions 28'a of the slide member 28' move free of the axle 8 so that it can move in slotted holes as it is written above in connection with FIG. 10. Since in the meantime the bolt 17 comes in its upper position, there is enough space for the divided forkshaped end portions 28'a to move in the left direction. If the slide member 28′ should be operated by push, the ends of the end portions 28′*a* move in right direction in the drawing.

The exemplary embodiment according to FIGS. 11 to 14 illustrates a heel holder 301 incorporating a further modification of the design and arrangement of the torsion spring 320. The torsion spring 320 is wound around the common pivot axle 7 for the sole holder 6 and the spring housing 311, with both legs of the torsion spring 320 extending forwardly in a direction toward the sole holder 6. When the binding is in the downhill skiing position, the torsion spring 320 is supported so that one of its legs 320*b* is supported on a bearing-block-fixed stop 305*a* and the other leg 320*a* is supported on a stop shoulder 22 secured to the sole holder 6. The two legs 320*a*, 320*b* cross each other as shown in particular in FIG. 11. Furthermore, the spring housing 311 also has a stop 311c, which in this position of the heel holder 301 oriented adjacent the base plate 4, is at an initial spacing from the leg 320*b* of the torsion spring 320 due to this leg being initially supported on the bearing-block-fixed stop 305*a*. The stop 311*c* of the spring housing 311 can be swung up in the plane in which the leg 320*b* of the torsion spring 320 is oriented. The torsion spring 320 fulfills, as this is explained in connection with the function of the heel holder 301, both the function of an opening spring and also a return spring.

The operation of the heel holder 301 corresponds during an automatic release operation, for example during a fall of the skier, to the exemplary embodiment of FIGS. 1–4.

Figure 11:
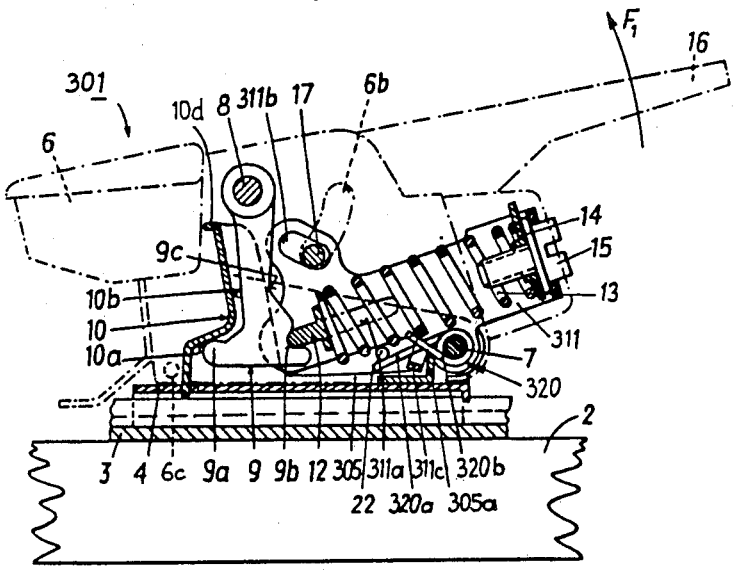
FIG. 11 is a central longitudinal cross-sectional view of a further embodiment of a safety ski binding which is in the downhill skiing position.
Figure 12:
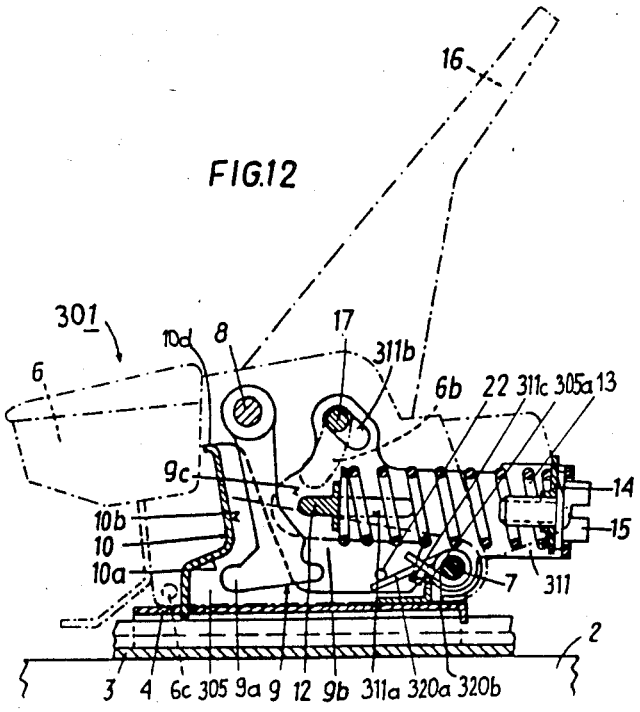
FIG. 12 is a central cross-sectional view of the safety ski binding in a first position during a voluntary opening.
Figure 14:
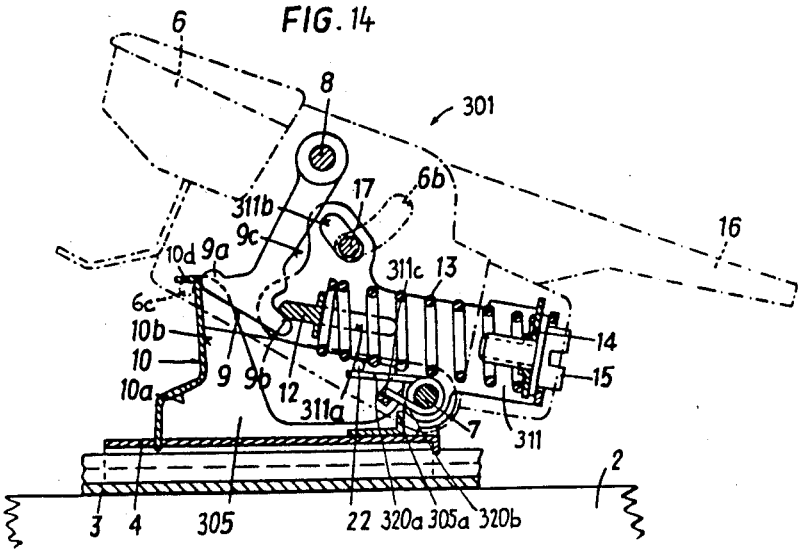
FIG. 14 illustrates the open position of the safety ski binding after a voluntary opening and after the occurrence of a safety release.

If now the heel holder 301 is opened voluntarily, then the release lever 16 is swung up for example manually in direction of the arrow $F_1$, which is shown in FIG. 11. The spring housing 311 is pivoted up about the axle 7 by action of the bolt 17 which is thereby also swung upwardly therewith in the arcuate slotted holes 6*b* which extend concentrically with respect to the axle 8 so that the locking member 12 is moved against the force of the spring 13 out of the locking notch 9*b* of the locking rocker arm 9. After this unlocking has occurred, the recess 9*c* of the locking rocker arm 9 located immediately above the locking notch 9*b* facilitates a relaxing of the release spring 13 (see FIG. 12), whereby now, however, the locking rocker arm 9 is no longer spring-loaded. Thus, the sole holder 6 will be pivoted upwardly under the action of the torsion spring 320, which in the first phase of the voluntary opening of the heel holder 301 acts as an opening spring. The locking rocker arm will be pivoted to a limited extent until it, sliding along the counterstop 10, reaches the upper part thereof as shown in Figure 14.

Figure 13:
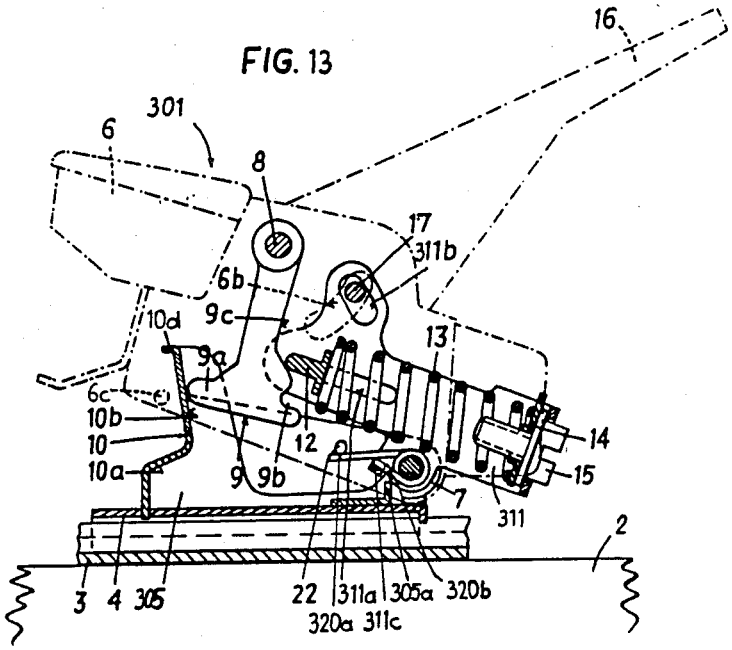
FIG. 13 is a central cross-sectional view of the safety ski binding in a section position during a voluntary opening.

FIG. 13 illustrates the heel holder 301 in a position wherein the sole holder 6 is not quite swung up yet, whereby the locking rocker arm 9 is in an intermediate position on the counterstop 10 and the leg 320*b* of the torsion spring 320 has slightly moved away from the bearing-block-fixed stop 305*a*. While the spring housing 311 has reached the predetermined, upwardly inclined position, the leg 320*b* of the torsion spring 320 supported on the bearing-block-fixed stop 305*a* in the skiing position has been lifted off from the stop 30*a* by means of the stop 311*c* which is secured to the spring housing 311, so that now the torsion spring 320 opposingly loads the sole holder 6 and the spring housing 311 with a spring force which is increased compared to the original initial spring force. Since the sole holder 6 takes along the locking rocker arm 9, the latter can pivot or swing free of any spring force about its axle 8 between the back surface 10*b* of the bearing-block-fixed counterstop 10 and the locking member 12 of the spring housing 311. Due to the swinging up of the sole holder 6 and relative thereto the downward urging of the spring housing 311, the locking rocker arm 9 is guided along the back surface 10*b* of the bearing-block-fixed counterstop 10. The shape of the back surface 10*b* of the counterstop 10 is chosen such that in the last phase of the upward movement of the sole holder 6, the locking member 12 and the spring housing 311 swing downwardly under the action of the torsion spring so that the locking member again is received in the locking notch 9*b* of the locking rocker arm 9. At the same time, the release lever 16, which is also supported on the bolt 17 is moved into its closed position, so that now the heel holder is in its ready-for-stepping-in position, which is illustrated in FIG. 14.

Figure 15:
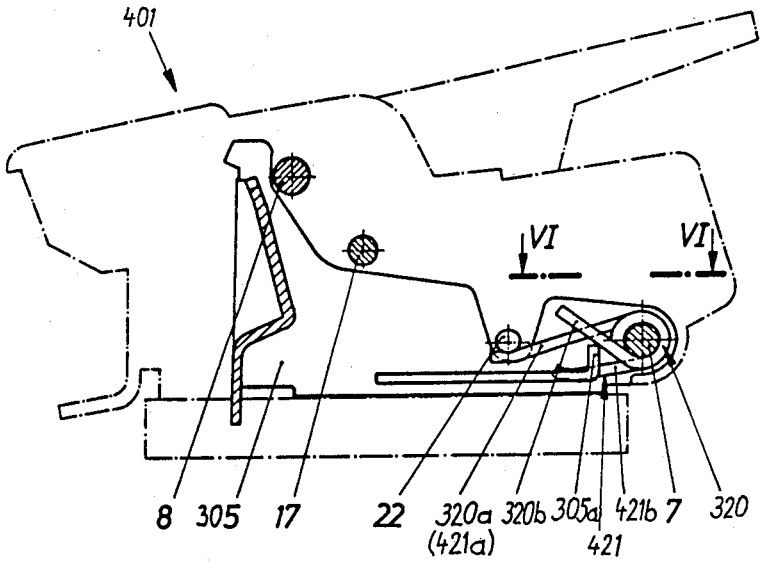
FIGS. 15 and 16 illustrate a further modification of the invention according to FIGS. 11 to 14 wherein an additional opening spring is utilized, specifically
Figure 16:
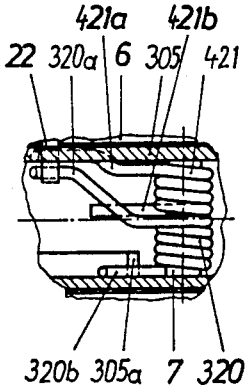

In the next embodiment of the invention according to FIGS. 15 and 16, a further torsion spring 421 is supported on the pivot axle 7 of the sole holder 6 of the heel holder 401, which torsion spring 421 has one of its legs 421*b* resting on the base plate of the bearing block 305 and the other of its legs 421*a* on the stop shoulder 22 which is secured on the sole holder 6. The shoulder extends inwardly from a side wall of the sole holder into the interior of the binding. The torsion spring 421 acts exclusively as an opening spring. It enhances, in the first phase of the voluntary opening, the effectiveness of the (first) torsion spring 320 which acts in the opening direction of the sole holder 6, through which enhancement it is to be avoided that in the case of an icing up or under unfavorable slope conditions, the heel holder 401 does not swing up satisfactorily or not totally, which can cause similar difficulties, as these disadvantageous difficulties have been discussed above in regard to the construction according to the first exemplary embodiment. The force of the torsion spring 421 which acts as an opening spring is thereby greater than the force of the torsion spring 320 which carries out a duplicate function, namely both an opening function and also a return function, so that the spring 320 always experiences a sort of a support on the sole holder 6.

The further design of the heel holder 401 according to FIGS. 15 and 16 corresponds to the heel holder 301 which is described above with reference to FIGS. 11 to 14. The operation of the heel holder 401 according to FIGS. 15 and 16 differs from the operation of the heel holder 301 in so far as the further torsion spring 421, as described, loads the sole holder 6 in the opening direction during the entire operational sequence of the voluntary opening and thus forms a defined support for the return of the spring housing 311 and the release lever 16 by means of the (first) torsion spring 320 in the second phase of the voluntary opening due to the operative connection to the sole-holder-fixed stop shoulder 22 by the one leg 320*a* of the torsion spring 320.

The invention is not to be limited to the illustrated exemplary embodiments. Further modifications are conceivable, without departing from the scope of the invention. Thus, it is possible in particular to pivotally support the bearing block on a vertical axle secured to the base plate extending in the horizontal plane and at the same time to provide at the front end region of the base plate a control cam which cooperates with a counterstop arranged on the sole holder, so that a so-called diagonal-release control exists. Furthermore, it is conceivable to arrange the torsion spring on an additional bolt which is supported on the sole holder. It is also possible to use in place of the torsion spring a leaf spring, one end of which is supported on the sole holder and the other end is supported preferably on the bolt which couples the spring housing with the release lever. The spring could also be supported on the spring housing itself. The arrangement of such a spring is, however, also possible in a binding system wherein the release spring is arranged in a cavity of the release lever itself. In this case it is then for example possible to support the spring on a portion of the release lever so that same is being loaded in a closing direction, which causes the spring housing to move with its locking member to the area of the locking notch of the locking rocker arm.

Furthermore, it is conceivable in the exemplary embodiment according to FIG. 10, to form the blocking for the axle of the locking rocker arm as a rocking lever.

According to this embodiment the rocking lever can be arranged e.g. on the pivot axle 107 and to be locked or to swing in its unlocked position. The form of the rocking lever is similar to one arm of the forkshaped part of the slide member 28' shown in FIG. 10*a*. The locking mechanism is spring loaded and can be engaged preferably with the block member 5 in a known way.

Furthermore, it is conceivable according to the exemplary embodiment of FIGS. 15 and 16 to permit the end regions of the individual legs 320*a* or 321*a* of the two torsion springs 320 or 321 supported on the sole holder to be supported on two separate stop shoulders, through which the designer receives greater freedom with respect to the differing initial tension of the two torsion springs 320 or 321.

The structural part which serves to receive the ski shoe therein and which can be pivoted up about the bearing-block-fixed pivot axle has been identified as such a "sole holder". However it is to be understood that this term is to include both the actual sole holder (in a more narrow sense), which serves to hold down the ski shoe heel, if desired by a common stepping spur which serves the stepping-in function, and the region which covers the bearing block in the skiing position and which is identified generally as a housing, on which region the sole holder is secured or hinged. In this connection it is pointed out that the component parts which have been identified as being sole-holder-fixed can also include a housing-fixed arrangement.

It is also pointed out that in all described exemplary embodiments, the force of the additional spring is smaller, preferably substantially smaller, than the force of the opening spring which loads the sole holder.

The invention can be used successful also in connection with the embodiments of our U.S. application Ser. No. 265,750.

The embodiments of the invention in which an exlusive property or privilege is claimed are defined as follows:

1. In a heel holder of a safety ski binding having a sole holder means and first support means pivotally supporting said sole holder means for movement between opened opened and closed positions and about a transverse axle supported on a bearing block secured to a base plate, a first spring means for continually urging said sole holder means into said opened position wherein said first spring means is positioned between said bearing block and said sole holder means a locking rocker arm pivotally supported on said sole holder means for holding said sole holder means in said closed position, said locking rocker arm having on one side thereof a locking projection which, in said closed position, grips under a counterstop arranged on said bearing block and having, on the other side thereof, a locking notch into which is received a locking member, at least one spring for continually urging said locking member toward said locking rocker arm, said sole holder means including spring housing pivotally supported by said support means for movement between said opened and closed positions, and a sole holder, and a coupling means for moveably coupling said sole holder to said spring housing for movement between first and second relative positions, said one spring being supported in said spring housing, a release lever for facilitating a voluntary movement of said sole holder means between said closed and opened positions, said release lever being movably supported on said sole holder means and having a bolt which couples said release lever to said spring housing, the improvement comprising wherein a second spring means is supported on and oriented between said sole holder and said spring housing for effecting a movement of said sole holder in a first direction from said first position to said second position towards a stepping in position in response to a movement of said spring housing in an opposite direction toward said opened position so that the following phase of a voluntary release will cause a relative movement between said sole holder and said spring housing and a return of said locking member into said locking notch.

2. The binding according to claim 1, wherein said first and second spring means are comprised of a single spring.

3. The binding according to claim 1, wherein during said voluntary release said release lever is operatively moved away from an initial posiiton relative to said sole holder, and wherein during said following phase of said voluntary release, said release lever is also returned to its initial position relative to said sole holder.

4. The binding according to claim 1, wherein said coupling means includes first means defining a first slot in said spring housing and second means defining a second slot in said sole holder, said bolt extending into said first and second slots, and wherein said second spring means is a torsion spring, one leg of which is supported on said bolt and the other leg of which is supported on said sole holder.

5. The binding according to claim 1, wherein said second spring means is a torsion spring, said torsion spring being supported on an axle which pivotally supports said locking rocker arm with said one leg thereof being supported on said sole holder spring housing and said release lever.

6. The binding according to claim 1, wherein a pivot axle pivotally supporting said sole holder is provided at a rear region of the binding, which rear region is adjacent to a base plate adapted to be secured to a ski, whereby said spring housing is supported on said pivot axle for said sole holder, wherein said coupling means includes first means defining a first slot in said spring housing and second means defining a second slot in said sole holder, said bolt extending into said first and second slots, and wherein said second spring means is a torsion spring, said torsion spring being supported on an axle which pivotally supports said locking rocker arm with one leg thereof being supported on said sole holder and the other leg thereof being supported on said bolt coupling said spring housing to said release lever.

7. The binding according to claim 1, wherein a pivot axle pivotally supporting said sole holder is arranged in the upper region of said bearing block, wherein said second spring means is a torsion spring, said torsion spring being supported on at least one of a pivot axle for pivotally supporting said sole holder and an axle which pivotally supports said locking rocker arm, one leg of which is supported on said bolt and the other leg of which is supported on said sole holder.

8. The binding according to claim 7, wherein said axle pivotally supporting said locking rocker arm is supported in two slotted holes provided in the side walls of said release lever and extend concentrically with respect to said pivot axle for said sole holder, wherein said release lever is pivotally supported on said pivot axle for said sole holder, and wherein said holder has a recess for receiving said bolt therein to facilitate a release of the binding.

9. The binding according to claim 8, wherein said two slotted holes are curved corresponding to a radius of said pivot axle pivotally supporting said sole holder.

10. The binding according to claim 8, wherein the pivotal range of said release lever is determined by the length of said two slotted holes, and wherein locking means are provided for voluntarily blocking movement of said axle pivotally supporting said locking rocker arm in said slots.

11. The binding according to claim 10, wherein said locking means is formed by a spring-loaded slide member movably supported in the longitudinal direction of said release lever on said release lever, said slide member having at one end an operating shoulder which can be gripped manually and at the other end at least one hook-shaped gripping element, which by operating the slide member grips around said axle for said locking rocker arm.

12. The binding according to claim 10, wherein said locking means is formed by a spring-loaded slide member movably supported in the longitudinal direction of said release lever on said release lever, said slide member having at one end an operating shoulder which can be gripped manually and at the other end is divided forkshaped and has two support elements thereon which straddle said locking rocker arm and through operation of said slide member can be moved under said axle for said locking rocker are.

13. The binding according to claim 1, wherein the force of said second spring means is smaller than the force of said first spring means.

14. The binding according to claim 1, wherein said first and second spring means are a single torsion spring arranged on a pivot axle pivotally supporting said sole holder and having forwardly extending legs, said legs crossing each other, whereby, in a ski shoe holding position and in a first phase of a voluntary opening, one of the legs extends downwardly from said pivot axle and engages a stop shoulder on said sole holder, the other leg extending upwardly from said pivot axle and engages from above a bearing-block-fixed stop, so that said torsion spring is active as an opening spring, and wherein said spring housing also has a stop thereon which is swingable in the plane of said other leg of said torsion spring supported on said bearing-block-fixed stop, said stop being initially oriented in a position below said other leg of said torsion spring, said stop in a second phase of said voluntary opening, wherein said locking member is in a position disengaged from said locking notch on said locking rocker arm, engages said other leg to lift same off from said bearing-block-fixed stop and starting with said second phase of said voluntary opening urges said spring housing toward its closing position with said locking rocker arm, so that the same said torsion spring is active as a return spring.

15. The binding according to claim 14, wherein in a last phase of the upward pivoting of said sole holder and said spring housing, there exists a spacing between said counterstop and said locking member which is greater than the spacing between a forward limit for said locking member and an upper rear limit on said locking notch on said locking rocker arm, so that said locking member extends into the region of said locking notch on said locking rocker arm through the action of said return spring without necessitating an overcoming of the spring force.

16. The binding according to claim 1, wherein said first spring means is a torsion spring arranged on a pivot axle for said sole holder, one of the legs of said torsion spring being supported on said bearing block and the other leg on a stop shoulder on said sole holder and which constantly urges said sole holder into the opening position.

17. The binding according to claim 16, wherein the force of said second spring means is substantially smaller than the force of said torsion spring.

* * * * *

UNITED STATES PATENT AND TRADEMARK OFFICE

CERTIFICATE OF CORRECTION

PATENT NO. : 4 629 209

DATED : Dec. 16, 1986

INVENTOR(S) : B. Lorenz et al

It is certified that error appears in the above-identified patent and that said Letters Patent is hereby corrected as shown below:

Column 15, line 59; delete "opened" (first occurence)

Column 15, line 64; after "means" insert ---, ---

Column 16, line 6; after "including" insert ---a---

Signed and Sealed this

First Day of September, 1987

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4 629 209

DATED : December 16, 1986

INVENTOR(S) : Bettstein et al.

It is certified that error appears in the above-identified patent and that said Letters Patent is hereby corrected as shown below:

On the Title Page:

Change First Inventor's Name from "Bettstein Lorenz" to

---Lorenz Bettstein---. (items 19 and 75)

Signed and Sealed this

Twenty-sixth Day of January, 1988

*Attest:*

DONALD J. QUIGG

*Attesting Officer*

*Commissioner of Patents and Trademarks*